United States Patent [19]

Braddon, Sr.

[11] 4,120,398

[45] Oct. 17, 1978

[54] PACKAGING SUPPORT STRUCTURE

[75] Inventor: George Dayman Braddon, Sr., Canandaigua, N.Y.

[73] Assignee: Mobil Oil Corporation, New York, N.Y.

[21] Appl. No.: 837,956

[22] Filed: Sep. 29, 1977

[51] Int. Cl.[2] ..... B65D 65/671; B65D 1/34; B65D 21/02

[52] U.S. Cl. ..... 206/408; 206/303; 206/391; 206/511; 229/2.5 R; 217/26.5

[58] Field of Search ..... 206/391, 394, 392, 403, 206/309, 303, 516, 408, 511, 395; 229/2.5; 217/25.5, 26, 26.5

[56] References Cited

U.S. PATENT DOCUMENTS

| | | | |
|---|---|---|---|
| 1,626,870 | 5/1927 | Oxhandler | 217/26 |
| 2,776,772 | 1/1957 | Itoda | 229/2.5 |
| 3,351,264 | 11/1967 | Bostrom | 217/26.5 |
| 3,685,646 | 8/1972 | Sy | 229/2.5 |

*Primary Examiner*—William T. Dixson, Jr.
*Attorney, Agent, or Firm*—Charles A. Huggett; Ronald J. Cier

[57] ABSTRACT

An improved tray structure for supporting a reel of tape-like film material wound on a flat annular hub which hub is substantially thicker than the width of the tape. The reel of tape is supported separately from the hub by means of raised portions in the bottom of the tray. By supporting the hub and tape separately, the reel is held in flat condition and its integrity maintained.

9 Claims, 5 Drawing Figures

FIG. 5
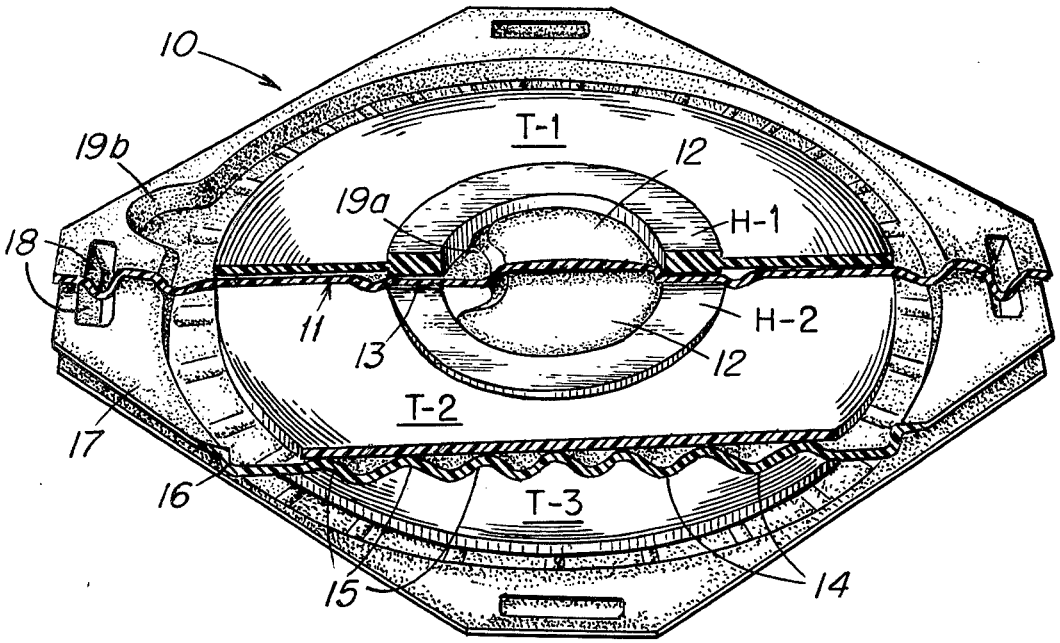
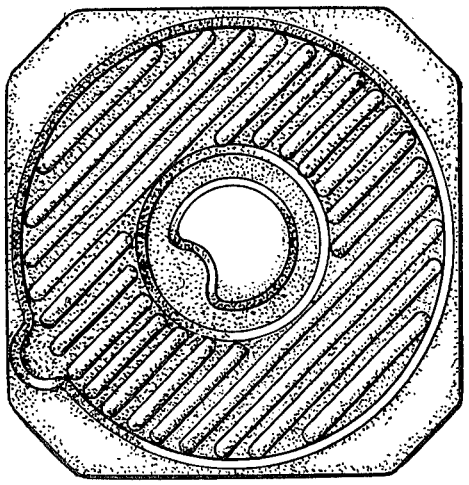
FIG. 4
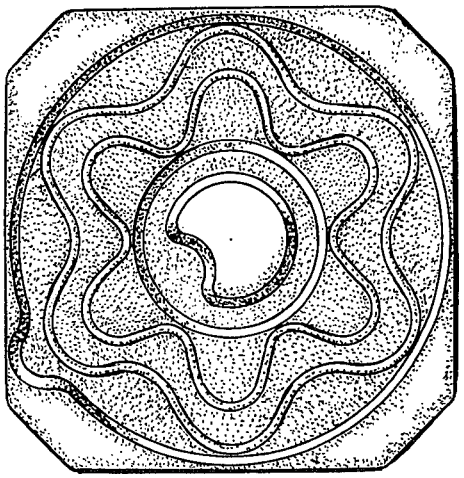
FIG. 3

PACKAGING SUPPORT STRUCTURE

BACKGROUND OF THE INVENTION

1 Field of the Invention

This invention is related to tray structures and particularly to support trays for the packaging of tape-like film material wound on a hub.

2. Description of the Prior Art

Manufacturers of tape material (e.g. magnetic recording tape) commonly wind their finished products in relatively large rolls on flat annular hubs to be sold to customers who will then repackage the tape into smaller rolls of more convenient size. When such relatively large rolls are packaged for shipping, they are normally placed in specially designed trays which immobilize the roll in the shipping container and at the same time support the wound tape and its center hub to prevent the tape reel from separating and uncoiling. These trays usually have a thin area which supports the hub and then a relatively thicker (higher gauge) area to separately support the tape and help maintain the flatness of the roll.

When the tape is substantially more narrow than the hub on which it is wound, as for instance, when one-eighth inch magnetic recording tape (manufactured for use in cassette recorders) is wound on the same standard sized hub as the wider recording tape normally used for computers and professional recording machines, a special problem is encountered which the usual type of support tray is not well suited to handle. When the differential between the hub thickness and the tape width becomes large, a uniformly thicker tape support area in the support tray becomes difficult to achieve. Also, a substantial increase in the gauge of this area requires a corresponding increase in construction material and, consequently, an undesirable increase in the cost and weight of the tray.

SUMMARY OF THE INVENTION

The invention herein disclosed encompasses an improved support tray for the packaging of tape-like film material wound on annular hubs which are of substantially greater thickness than the width of the tape. The tray comprises a bottom support wall having a raised center portion adapted to fit within the smaller inside circumference of the annular hub structure. The raised center portion is surrounded by a concentric annular ring, or hub support zone, which is of substantially the same size as the hub, and this in turn is surrounded by a second larger annular zone or "field area" having an increased thickness profile (i.e. vertical cross-section) relative to the hub support zone. The increased profile of the second annular zone is achieved by elevating portions of the bottom wall throughout the field area, such elevated portions providing a rest surface for support of the reel of tape wound on the hub.

The tray may optionally have an integral side wall projecting upwardly from the bottom wall to a height which is substantially the same as or slightly greater than that of the raised center portion of the tray. Such upstanding side wall may also have an upper peripheral edge or lip projecting horizontally to impart a substantially rectangular outside dimension to the tray so that each tray will fit snugly inside a carton containing a stack of such trays. The horizontal projection may contain one or more stacking lugs formed therein, such lugs comprising downward deformations of the horizontal projection which extend slightly below the level of the bottom wall to engage the corresponding lugs in the next lower tray in the stack thereby arresting any twisting tendencies of the stack. Two concave indentations, one in the raised center portion of the bottom wall and the other directly opposite it in the upstanding side wall, provide convenient places for grasping the roll of tape prior to its removal from the tray.

The dimensions of the several elements of the tray are such that, when a roll of tape is placed in the tray, the annular hub of the roll nests in the hub support zone and the raised center portion of the tray restricts lateral movement of the hub. The elevated portions of the field area support the relatively more narrow tape and maintain the desirable physical integrity of the roll, i.e. keep the roll flat and prevent it from separating and uncoiling.

BRIEF DESCRIPTION OF THE DRAWINGS

FIGS. 3 and 4 show examples of some alternate patterns for the raised portions of the field area; and FIG. 5 is a perspective view showing a stack of trays of the embodiment of FIG. 1, with cutaway portions showing the manner of supporting the components of conventional reels of tape-like film material.

DESCRIPTION OF THE PREFERRED EMBODIMENTS

Figure 1:
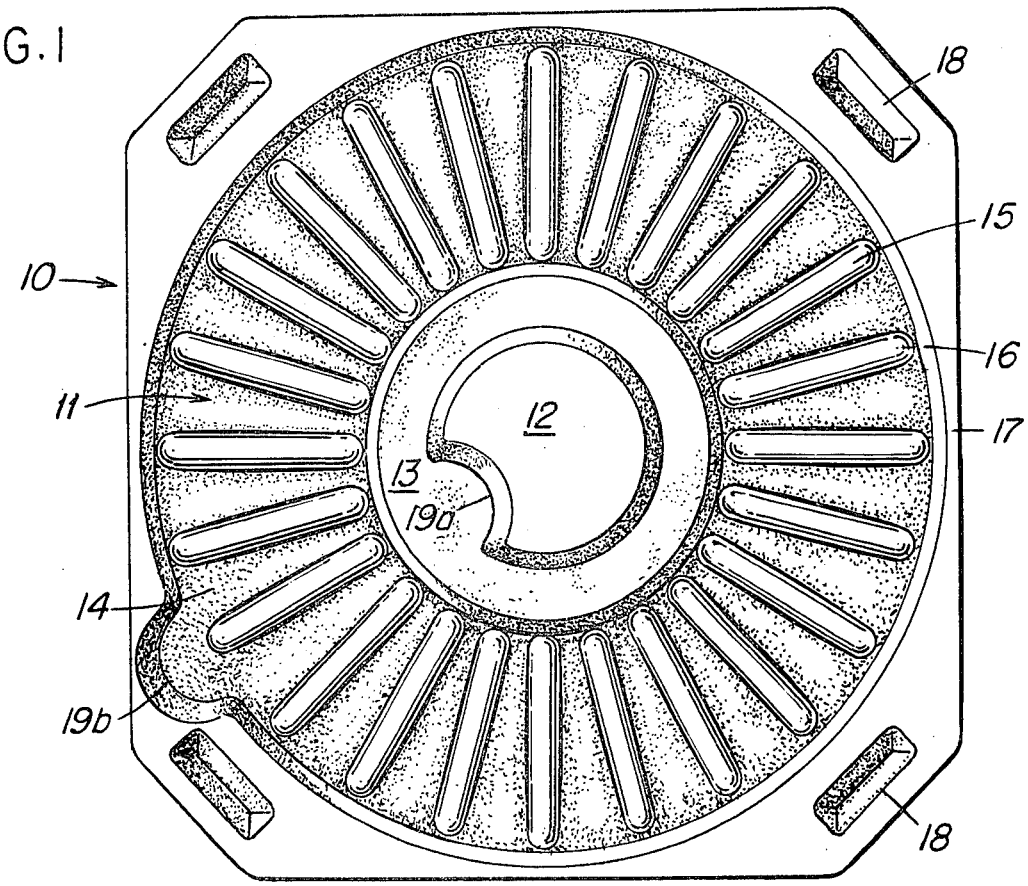
FIG. 1 is a top plan view of a packaging support tray encompassing features of my invention.

Embodiments of the packaging support tray structures of my invention for holding magnetic recording tape wound on a standard annular hub are depicted in the drawings. Referring to FIG. 1, it can be seen that the tray 10 is comprised of a bottom wall 11 having an integral upstanding sidewall 16 which terminates in a horizontally projecting lip or edge 17. The bottom wall 11 is divided into three concentric sections, i.e. raised center portion 12, first annular zone 13 surrounding portion 12, and second annular zone 14 surrounding zone 13.

Raised center portion 12 is preferably of substantially circular geometry and is designed to fit within the inner circumference of the above-mentioned annular hub and to thereby restrict any significant lateral movement of such hub while it is resting on the tray. First annular zone 13 serves as the hub support zone and is of substantially the same inner and outer diameters as the hub. The second annular zone 14 is of increased thickness, relative to the thickness of hub support zone 13, and provides a rest surface upon which a roll of tape material, wound on an annular hub, is supported.

The thickness differential between hub support zone 13 and the tape support zone or "field area" 14 is important when one is concerned with packaging a reel of tape wherein the tape is of substantially less width than the thickness of the hub upon which it is wound. The reason for control of the thickness differential is that, unless the tape reel is fully supported and maintained in a substantially flat condition, there is a high probability that the integrity of the reel will be broken and the tape will unwind, spilling out of the support tray and onto the floor, understandably a very undesirable situation. In order to achieve the desired thickness differential between the two support zones of bottom wall 11 without increasing the amount of construction material or the weight of the tray, there are distributed throughout the field area 14 raised rib portions 15 which provide a surface for support of the entire width of the reel of wound tape material. The tops of raised rib portions 15 describe a plane substantially parallel to the bottom surface 11 of the tray structure, the plane being elevated above hub support zone 13 a distance approximately equal to half the difference between the thickness of the hub and the width of the tape material. By this means the hub and the reel are each fully and separately supported, thereby maintaining the original flat condition of the wound tape material and minimizing any danger that the reel of tape will open at some intermediate point and the tape will become partially or completely unwound.

FIG. 1 also depicts several optional features of the preferred tray structure which enhance its stackability and covenience. The sidewall 16, which projects upwardly from the bottom wall 11 to a height substantially the same as or slightly greater than that of raised center portion 12, has projecting outwardly from its upper edge a horizontal lip 17. Lip 17 is shown as being extended into a substantially rectangular configuration, allowing the tray to fit snugly into a suitable packing carton (not shown). The corners of the rectangular outer configuration of the tray have been removed to facilitate ease of placement in and removal of the tray from the carton. One or more stacking lugs 18 are formed in lip 17 and project downwardly therefrom. The depth of lugs 18 are such that, when tray 10 is placed in a stack of such trays, each holding a reel of tape wound on a hub, each lug 18 will extend into a corresponding lug of the tray below it and thereby arrest any tendency of the tray to rotate and cause the stack to twist.

An additional optional feature of the present invention are indentations **19*a* (in center hub 12) and 19*b* (in upstanding sidewall 16**). These indentations are preferably positioned opposite one another and provide convenient places for grasping the roll of tape material prior to removal from the tray.

Figure 2:
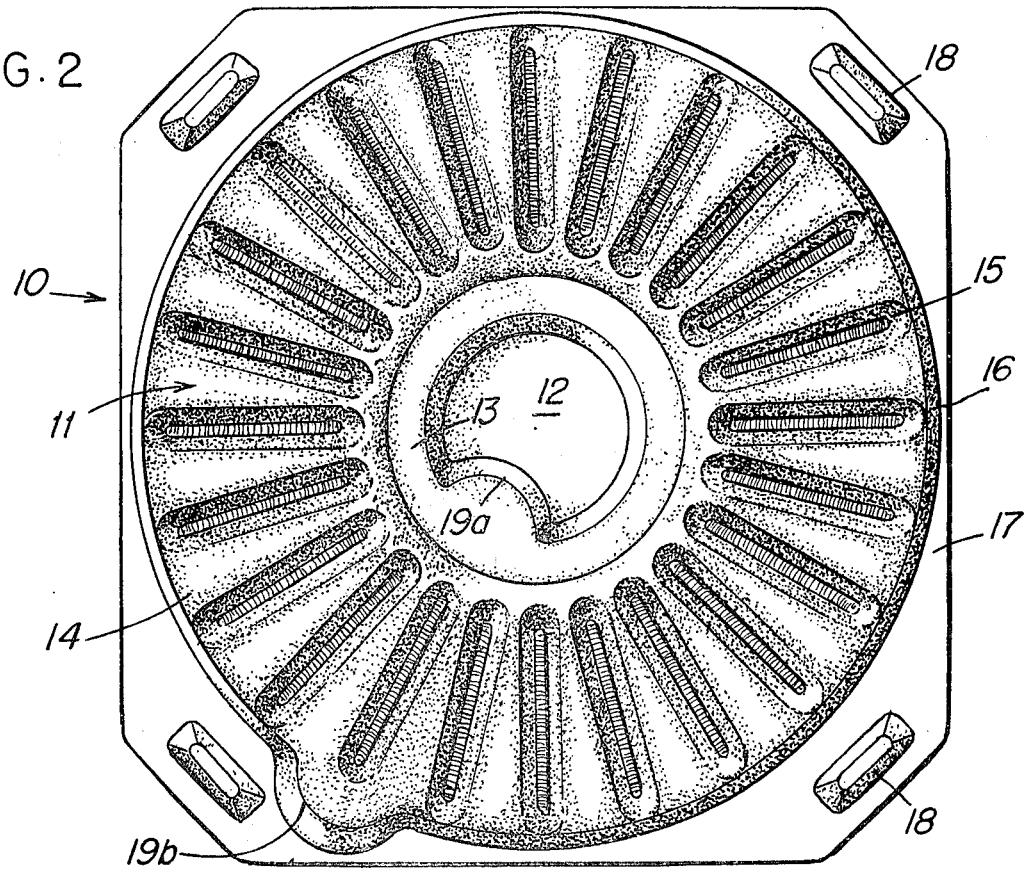
FIG. 2 is a bottom view of the tray structure of FIG. 1.

Although FIGS. 1 and 2 show a tray structure wherein the raised portions 15 in the field area 14 form a pattern of radially extending elongated ribs, it is not to be construed that this contemplated as being the only operable configuration for such raised portions 15. The pattern and configuration of such raised portions are a design consideration which provide no limitation on the concept disclosed herein, so long as they are sufficiently distributed throughout field area 14 to support the entire width of the reel of tape material and are of substantially equal height to provide a flat support surface for such reel. Examples of other raised rib patterns are shown in FIGS. 3 and 4 (substantially circular ribs and linear ribs, respectively), and numerous other suitable configurations will occur to those skilled in the art. Indeed, such raised portions need not form any discernable pattern at all, but may be entirely random as long as they satisfy the two limitations given above.

FIG. 5 demonstrates the manner in which the tray structure 10 supports a reel of tape material T-1 (T-2, T-3) wound on an annular hub H-1 (H-2). As can be seen in the cutaway sections, the hub H-1 (H-2) rests in the hub support zone 13 while the reel of tape T-1 (T-2, T-3) is separately supported by raised rib portions 15. Also shown is the interlocking action of the lugs 18 to prevent rotation of the trays and keep the stack from twisting.

The tray structure of the present invention may be constructed of any conventional, reasonably rigid material which would normally be used to fabricate support trays, such as metal, pressed paper pulp, plastic, and so forth. Preferred are substantially rigid thermoformable plastic materials, such as urethane, vinyl or a sandwich construction of foam core and film sheathing of various materials, and especially preferred is polystyrene foam plastic. Suitable thicknesses of foam polystyrene sheet material useful in forming packaging support trays as embodied herein range from 1/32 (31 mils) to ½ inch (500 mils), and especially preferred is foam sheet material from 1/16 (62 mils) to ¼ inch (250 mils) in thickness.

EXAMPLE

A packaging tray for supporting a reel of 0.4 cm wide magnetic recording tape wound on an annular plastic hub (inside radius = 3.8 cm; outside radius = 5.8 cm; thickness = 1.0 cm) was constructed after the embodiment of FIGS. 1 and 2 using conventional thermoforming technology. The tray was formed from polystyrene foam sheet material approximately 200 mils in thickness and had an overall outside width of 28 cm by 28 cm as measured at lip 17. The center portion 12 was raised 1.0 cm above hub support zone 13 and had a radius of 3.8 cm. The concentric hub support zone 13 was 0.18 cm (90 mils) thick and had an outside radius of 5.9 cm. Field area 14 had an outside radius of 26.5 cm and contained raised radial ribs 15 which extended from zone 13 to sidewall 16 and the tops of which defined a plane elevated approximately 0.3 cm above hub support zone 13, thereby giving field area 14 a total nominal thickness of 0.64 cm. Side wall 16 supported lip 17 at the same height above the bottom wall of the tray as center portion 12, and stacking lugs 18 (4 cm long by 1 cm wide at the top) extended approximately 2 cm below lip 17. Curved indentations **19*a* and 19*b*** were each defined by an arc measuring approximately 2 cm.

While the tray structure of my invention has been described with reference to particular embodiments (i.e. for supporting relatively narrow magnetic recording tape wound around standard sized plastic hubs), it is to be understood that the concept disclosed herein has application to other materials as well. Such reference is merely for the purposes of explaining my invention and is not intended to be limiting in any way. Numerous other applications and embodiments will readily occur to those skilled in the art and are to be emcompassed within the spirit and scope of the appended claims.

Having thus described my invention, I claim:

1. In an improved tray structure for the support of a reel of tape-like film material wound on flat annular hub, said hub having a large outside circumference on which the tape is wound and a relatively smaller inside circumference; said tray being characterized by having a bottom support wall having a raised center portion adapted to fit within said smaller inside circumference of said hub to restrict the lateral movement of said hub across said bottom wall; said bottom wall being further characterized by a first annular zone disposed around said raised center portion and of substantially the same inside and outside diameter of said annular hub, and a second annular zone concentric with said first annular zone and having a thickness profile which is relatively greater than that of said first zone, such that when a roll of said tape-like material is placed on said bottom wall, said first annular zone will support the hub and said second annular zone will support the tape wound on said hub; the improvement comprising;

means in said second annular zone for supporting a roll of the tape-like film material, which tape is substantially more narrow than the hub on which it is wound, comprising a plurality of elevated portions in said bottom wall distributed throughout said second annular zone, the top (portion) of said elevated portions providing a rest surface comprising a plane elevated above the surface of said first annular zone by an amount substantially equal to half the difference between the thickness of said annular hub and the width of said relatively narrow tape-like film material, which elevated rest surface separately supports said reel of said relatively narrow tape in a substantially flat configuration and aids in maintaining the physical integrity of said reel.

2. The improved tray structure of claim 1 wherein said elevated portions are radially extending ribs.

3. The improved tray structure of claim 1 wherein said elevated portions are linear ribs.

4. The improved tray structure of claim 1 wherein said elevated portions are raised sections.

5. The improved tray structure of claim 1 wherein said elevated portions are substantially circular ribs.

6. The improved tray structure of claim 1 further comprising an integral sidewall projecting upwardly from the periphery of said bottom wall; said sidewall terminating in an outwardly projecting lip; said lip being extended to impart a substantially rectangular outside dimension to said tray structure.

7. The structure of claim 6 further comprising one or more downwardly protruding stacking lugs formed in said outwardly projecting lip; which lugs are designed to engage the corresponding lugs in the next lower tray in a stack of such tray structures to prevent said trays from rotating.

8. The improved tray structure of claim 1 constructed from substantially rigid plastic material.

9. The improved tray structure of claim 8 wherein said substantially rigid plastic material is foamed polystyrene.

* * * * *